US006594954B1

(12) United States Patent
Kennedy et al.

(10) Patent No.: US 6,594,954 B1
(45) Date of Patent: Jul. 22, 2003

(54) MINE DOOR INSTALLATION

(75) Inventors: William R. Kennedy, Taylorville, IL (US); John M. Kennedy, Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 0 days.

(21) Appl. No.: 10/037,514

(22) Filed: Jan. 4, 2002

(51) Int. Cl.[7] ..... E05F 11/24; E02D 29/00; E21F 1/14

(52) U.S. Cl. ..... 49/340; 49/339; 49/344; 405/132; 454/169

(58) Field of Search ..... 49/123, 118, 368, 49/366, 501, 505, 381, 339, 340, 344, 346; 405/132, 151–153, 141, 143, 147, 150.1; 52/217, 126.4; 16/49, 50; 454/169, 168; 60/407; 417/375

(56) References Cited

U.S. PATENT DOCUMENTS

| | | | | |
|---|---|---|---|---|
| 2,564,067 A | | 5/1951 | Karp | |
| 2,926,012 A | | 2/1960 | Maher | |
| 3,125,232 A | | 3/1964 | Brinkman et al. | |
| 3,699,717 A | * | 10/1972 | Hedrick | 49/336 X |
| 3,936,977 A | * | 2/1976 | Runft et al. | 49/340 X |
| 3,993,355 A | | 11/1976 | Cunningham | |
| 4,094,158 A | * | 6/1978 | Le Vere et al. | 49/199 X |
| 4,222,147 A | | 9/1980 | Burnett, Jr. | |
| 4,334,408 A | | 6/1982 | LaPointe | |
| 4,375,735 A | | 3/1983 | Rhoads | |
| 4,637,475 A | | 1/1987 | England et al. | |
| 5,222,838 A | | 6/1993 | Kennedy et al. | |
| 5,240,349 A | | 8/1993 | Kennedy et al. | |
| 5,394,651 A | * | 3/1995 | Vial | 49/340 X |
| RE36,853 E | | 9/2000 | Kennedy et al. | |
| 6,138,412 A | * | 10/2000 | Rieckmann et al. | 49/340 X |
| 6,279,315 B1 | * | 8/2001 | Harju | 60/410 |
| 6,425,820 B1 | * | 7/2002 | Kennedy et al. | 454/169 |

FOREIGN PATENT DOCUMENTS

| | | | | |
|---|---|---|---|---|
| FR | 2615237 | * | 11/1988 | 49/340 |
| GB | 2 255 948 A | | 11/1992 | |
| WO | WO 01/75271 A1 | | 10/2001 | |

* cited by examiner

*Primary Examiner*—Daniel P. Stodola
*Assistant Examiner*—Hugh B. Thompson
(74) *Attorney, Agent, or Firm*—Senniger, Powers, Leavitt & Roedel

(57) ABSTRACT

A power mine door installation utilizing compressed air from the compressed air system available in the mine as the power source for a hydraulic door-operating mechanism.

5 Claims, 2 Drawing Sheets

MINE DOOR INSTALLATION

BACKGROUND OF THE INVENTION

This invention relates to a mine door installation, and more particularly to a power-operated mine door system installed in a passageway in a mine.

The invention is especially concerned with a mine door system wherein doors for a passageway in a mine are adapted for powered opening and closing by means of hydraulic instrumentalities (specifically hydraulic cylinders).

SUMMARY OF THE INVENTION

Among the several objects of the invention may be noted the provision of a mine door system having a door-operating hydraulic instrumentality (such as a hydraulic cylinder) for a door thereof (or two such instrumentalities for a pair of doors) which is safely operable in a dangerous environment down in a mine (e.g. in a passageway where there may be explosive gas); the provision of a system such as described which eliminates the need for electrical empowerment (e.g. eliminates the need for an electric motor) and thus avoids arcing and sparking which might set off an explosion; the provision of such a system taking advantage of a power source in the mine for other purposes; and the provision of such a system which is relatively economical to install and reliable in operation.

The invention takes advantage of the compressed air system conventionally available in a mine, generally comprising the provision of an air motor for driving a pump for supplying hydraulic fluid under pressure to a hydraulic instrumentality for operating a door in the mine, and a compressed air circuit for supplying the air motor with compressed air from said compressed air system in the mine.

Other objects and features will be in part apparent and in part pointed out hereinafter.

DETAILED DESCRIPTION

Figure 1:
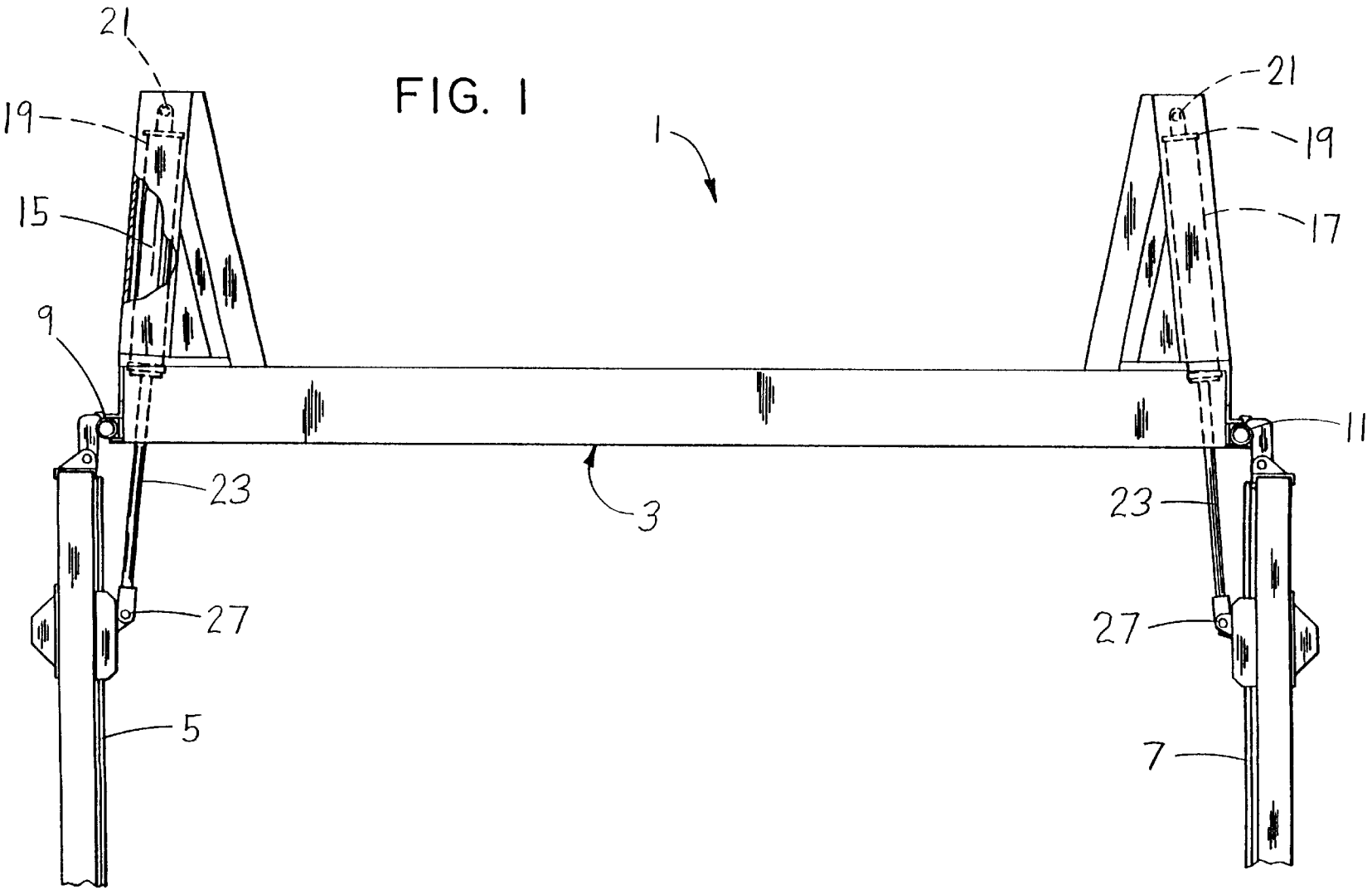
FIG. 1 is a top plan view of a double-door mine door arrangement having a hydraulic cylinder for operating each of the door components.

FIG. 1 shows a power mine door installation, generally designated 1, for a doorway in a mine comprising a door frame generally indicated at 3 having a pair of door components 5 and 7 (each a generally rectangular door leaf) hinged on the frame as indicated at 9 and 11 at opposite sides of the doorway for swinging movement between open and closed positions. The door leafs are shown in open position in FIG. 1; in closed position they are generally coplanar. Leafs 5 and 7 are swingable between their open and closed positions by means of hydraulic instrumentalities. In one embodiment, these instrumentalities comprise hydraulic cylinders 15 (for leaf 5) and 17 (for leaf 7), each pivoted at its head end 19 on the frame 3 as indicated at 21 and having its piston rod 23 extending from its piston 25 (see FIG. 2) to a pin connection 27 with the respective leaf.

Figure 2:
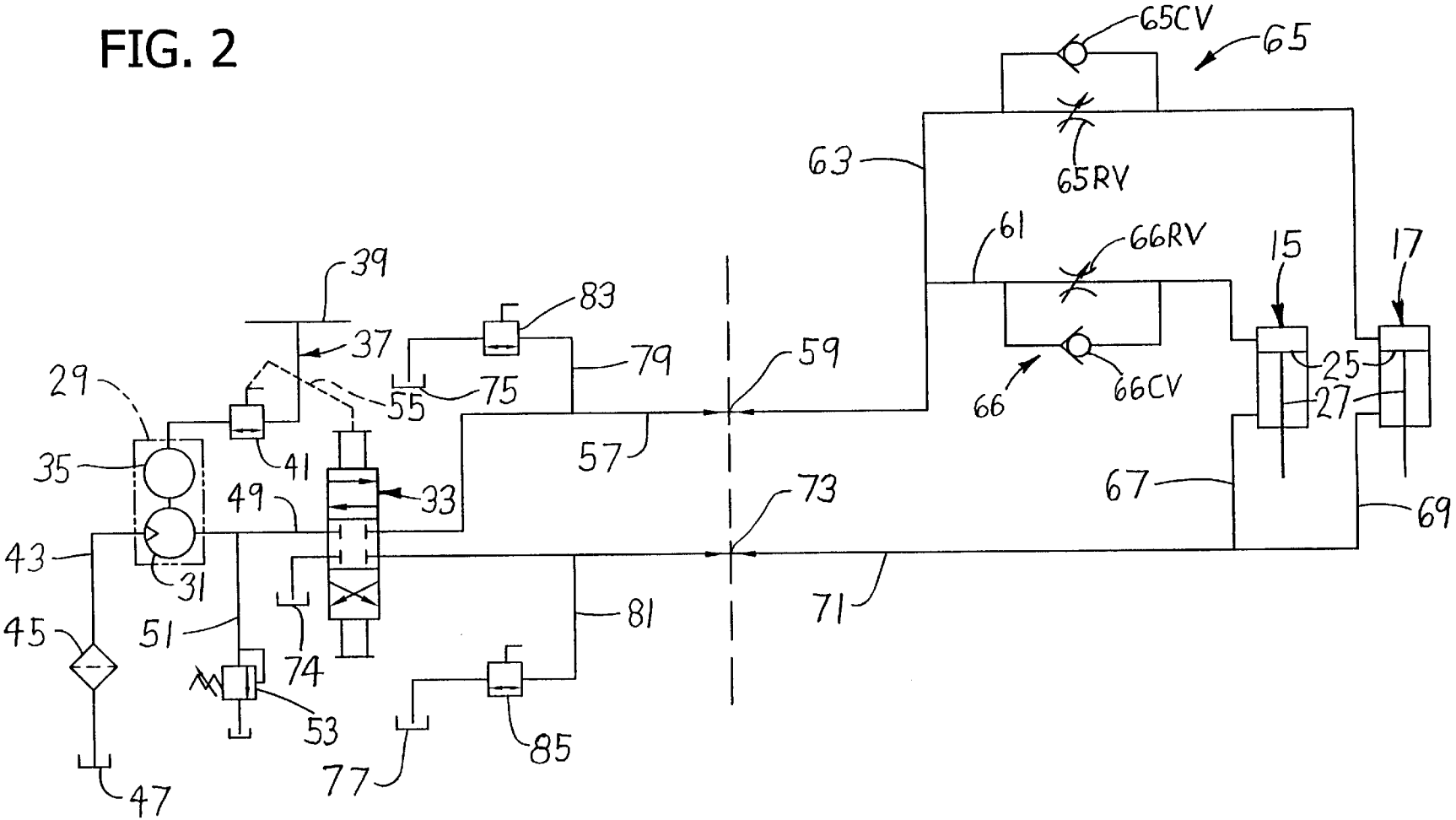
FIG. 2 is a diagram showing hydraulic and air circuitry of the invention for operating the door components.

Now referring to FIG. 2, the power mine door installation 1 is shown to include a pumping unit 29 comprising a pneumatically driven pump 31 for supplying hydraulic fluid under pressure to the hydraulic cylinders 15, 17 for operation thereof to operate the respective door leafs 5, 7 via a four-way valve 33 which can be operated manually or by any other suitable means (e.g., solenoid, pilot, motor). Unit 29 further comprises an air motor 35 for driving pump 31. At 37 is generally indicated a compressed air circuit for supplying air motor 35 with compressed air from a compressed air system 39 in the mine, said circuit including an on-off valve 41 therein. System 39 is preferably one conventionally available in a mine for supplying compressed air generally for mine-related purposes as will be readily understood. Alternatively, the system 39 could be a dedicated system provided for the sole purpose of supplying air under pressure to air motor 35.

The pump 31 is adapted to receive hydraulic fluid via line 43 including a filter 45 from a supply at 47 and deliver it under pressure to the inlet of valve 33 via a line 49, with a pressure relief line 51 extending from line 49 including a pressure relief valve 53. At 55 is indicated in phantom an interconnection between valve 41 and valve 33 for synchronization of operation thereof such that the air valve 41 is opened to start the air motor 35 at substantially the same time as the valve 33 is actuated to either the "open door" or "close door" position. In a first setting of valve 33, it is adapted to deliver hydraulic fluid under pressure via line 57 including a quick-connect coupler 59 and branch lines 61 and 63 including flow controls designated 65 and 66, respectively, to the head ends of cylinders 15, 17 and vents the rod ends of the cylinders via branch lines 67 and 69, line 71, quick-connect 73 and valve 33 to tank 74. In a second setting of the valve 33, it delivers hydraulic fluid under pressure via 71, 67, and 69 to the rod ends of the cylinders and vents the head ends of the cylinders via 61, 63, 59, 57 and valve 33 to tank 74. Lines 57 and 71 are connected to sumps 75 and 77 via lines 79 and 81 including release valves 83 and 85, respectively. In the case of malfunction or a loss of power, these release valves may be opened manually to depressurize the system and allow the door components 5, 7 to be operated (opened and/or closed) by hand.

It will be apparent from the above that with the pump 31 in operation and valve 33 in its first setting, the piston rods 27 will be extended to open the door components (leafs) 5 and 7, and that with the pump 3 in operation and valve 33 in its second setting, the piston rods will be retracted to close the door components. The operation of the pump 31 by the air motor 35, which is economically effected because the compressed air system 39 is already there in the mine, avoids the danger (such as may be caused by use of an electric motor and associated equipment) of explosion in the event of presence of explosive gas.

In one embodiment, each flow control 65, 66 includes a check valve 65CV, 66CV and a fluid restricting (e.g., needle) valve 65RV, 66RV for restricting the flow of fluid. In the first setting of the valve 33, the check valves 65CV, 66CV open to allow full flow of hydraulic fluid under pressure to the cylinders 15, 17 to open the doors leafs. In the second setting of the valve 33, the check valves 65CV, 66CV close and the hydraulic fluid flows through the restricting valves 65RV, 66RV to control the closing speed of the door leafs (i.e., to prevent door runaway). The restricting valves 65RV, 66RV can also be used to control the closing sequence of the door components 5, 7. For example, if one of the components is a door leaf carrying an astragal sealing flap, the restricting valves can be configured so that the door leaf with the flap closes last to ensure proper sealing of the flap against the other door leaf.

Means other than on-off valve 41 may be used to synchronize the operation of the air circuit 37 and the hydraulic fluid valve 33. Indeed, this valve may be eliminated altogether, in which case the required synchronization can be effected simply by turning the air motor 35 on and off, for example.

In view of the above, it will be seen that the several objects of the invention are achieved and other advantageous results attained.

As various changes could be made in the above constructions without departing from the scope of the invention, it is intended that all matter contained in the above description or shown in the accompanying drawing shall be interpreted as illustrative and not in a limiting sense.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A power mine door installation for a doorway in a mine, said mine having a compressed air system therein, said installation comprising:

a door component swingable between open and closed positions in the doorway;

a hydraulic instrumentality for operating the door component;

a pump for supplying hydraulic fluid under pressure to said hydraulic instrumentality for operation thereof to operate the door component;

an air motor for driving the pump; and a compressed air circuit for supplying the air motor with compressed air from said compressed air system in the mine.

2. The power mine door installation as set forth in claim 1 wherein said hydraulic instrumentality comprises a hydraulic cylinder.

3. The power mine door installation as set forth in claim 2 further comprising a hydraulic fluid valve controlling delivery of hydraulic fluid to and venting of fluid from said cylinder, and an on-off valve in said compressed air circuit, operation of the compressed air circuit valve and the hydraulic fluid valve being synchronized such that compressed air is delivered to the air motor by the compressed air circuit upon actuation of the hydraulic fluid valve.

4. A power mine door installation for a doorway in a mine, said mine having a compressed air system therein, said installation comprising a pair of door leafs swingable between open and closed position in the doorway;

a pair of hydraulic cylinders for operating the door leafs;

a pump for supplying hydraulic fluid under pressure to said cylinders for operation thereof to operate the door leafs;

an air motor for driving the pump; and a compressed air circuit for supplying the air motor with compressed air from said compressed air system in the mine.

5. The power mine door installation as set forth in claim 4 having a valve controlling delivery of hydraulic fluid to and venting of fluid from said cylinders, and an on-off valve in said compressed air circuit, operation of the compressed air circuit valve and the hydraulic fluid valve being synchronized such that compressed air is delivered to the air motor by the compressed air circuit upon actuation of the hydraulic fluid valve.

* * * * *